US009979131B2

(12) United States Patent
Venkatesan et al.

(10) Patent No.: US 9,979,131 B2
(45) Date of Patent: May 22, 2018

(54) ELECTRICAL CONNECTOR ASSEMBLY WITH IMPROVED LOCKING DEVICE

(71) Applicant: Delphi International Operations Luxembourg S.A.R.L., Bascharage (LU)

(72) Inventors: Sathishkumar Venkatesan, Chennai (IN); Thulasiraman Shanmugam, Chennai (IN); Anup Job Sebastian, Chennai (IN)

(73) Assignee: Delphi International Operations Luxembourg SARL, Luxembourg (LU)

( * ) Notice: Subject to any disclaimer, the term of this patent is extended or adjusted under 35 U.S.C. 154(b) by 0 days. days.

(21) Appl. No.: 15/603,974

(22) Filed: May 24, 2017

(65) Prior Publication Data

US 2017/0352985 A1 Dec. 7, 2017

(30) Foreign Application Priority Data

Jun. 2, 2016 (EP) ..... 16172635

(51) Int. Cl.
*H01R 13/639* (2006.01)
*H01R 43/26* (2006.01)

(52) U.S. Cl.
CPC ..... *H01R 13/639* (2013.01); *H01R 43/26* (2013.01)

(58) Field of Classification Search
CPC ..... H01R 13/639; H01R 43/26
USPC ..... 439/350
See application file for complete search history.

(56) References Cited

U.S. PATENT DOCUMENTS 5,830,002 A * 11/1998 Ito ..... H01R 13/6272 439/358
6,024,595 A * 2/2000 Saba ..... H01R 13/6272 439/352
6,077,101 A * 6/2000 Garretson ..... H01R 13/627 439/352
6,435,895 B1 * 8/2002 Fink ..... H01R 13/6272 439/352
6,780,045 B2 * 8/2004 Shuey ..... H01R 13/6272 439/352

(Continued)

FOREIGN PATENT DOCUMENTS

EP 821441 A2 1/1998
EP 1209770 A2 6/2004

(Continued)

*Primary Examiner* — Alexander Gilman
(74) *Attorney, Agent, or Firm* — Robert J. Myers

(57) ABSTRACT

The present invention relates to an electrical connector assembly and a method to assemble the same. The electrical connector assembly includes a plug connector that is configured to be mated with a corresponding counter-connector. The plug connector includes a connector housing having a guiding feature and a locking device being arranged movable relative to the connector housing. The locking device has a guiding member and a flexible arm. The flexible arm is configured to be flexed during mating the plug connector with the corresponding counter-connector such that the locking device can be moved into a locked position. The guiding feature and the guiding member are configured to guide the locking device from a first position to a locked position so that the flexible arm is reflexed when the locking device is in the locked position.

13 Claims, 8 Drawing Sheets

(56) References Cited

U.S. PATENT DOCUMENTS

| | | | | |
|---|---|---|---|---|
| 7,326,074 | B1 * | 2/2008 | Lim | H01R 13/629 439/352 |
| 8,016,606 | B1 * | 9/2011 | Kwan | H01R 13/641 439/352 |
| 8,678,846 | B2 * | 3/2014 | Hitchcock | H01R 13/6272 439/352 |
| 2002/0052135 | A1 * | 5/2002 | Noguchi | H01R 13/4367 439/352 |
| 2002/0064997 | A1 * | 5/2002 | Noguchi | H01R 13/641 439/607.01 |
| 2011/0045683 | A1 * | 2/2011 | Foung | H01R 13/6272 439/352 |
| 2013/0237081 | A1 * | 9/2013 | Kon | H01R 13/6272 439/350 |
| 2013/0237083 | A1 * | 9/2013 | Kon | H01R 13/6272 439/354 |
| 2013/0237084 | A1 * | 9/2013 | Kon | H01R 13/6272 439/354 |
| 2014/0134867 | A1 * | 5/2014 | Kon | H01R 13/627 439/345 |
| 2016/0118741 | A1 * | 4/2016 | Schmidt | H01R 13/6272 439/131 |

FOREIGN PATENT DOCUMENTS

| | | | |
|---|---|---|---|
| EP | 2637262 | A1 | 9/2013 |
| EP | 3016213 | A1 | 5/2016 |
| JP | 03285280 | A | 12/1991 |

* cited by examiner

ELECTRICAL CONNECTOR ASSEMBLY WITH IMPROVED LOCKING DEVICE

CROSS-REFERENCE TO RELATED APPLICATION

This application claims the benefit under 35 U.S.C. § 119(a) of Patent Application No. 16172635.1 filed in the European Patent Office on Jun. 2, 2016, the entire disclosure of which is hereby incorporated by reference.

TECHNICAL FIELD OF THE INVENTION

The present invention relates to an electrical connector assembly with a locking device.

BACKGROUND OF THE INVENTION

The safe coupling of connectors is of high importance for many applications. For example, modern passenger cars include a variety of different electrical connections. For ensuring that connectors mated with a corresponding counter-connector cannot become loose unintentionally, additional locking devices are known in the art to guarantee a safe mechanical coupling between the connector and counter-connector. These locking devices are often referenced as secondary locking devices and are provided as a separate element.

Further, it is also desirable to indicate, either visually or physically, that a plug connector has been fully and properly mated with a corresponding counter-connector during the assembly procedure for allowing a "fool-proof" assembly. In order to reduce the risk associated with improperly mated connectors, so-called connector position assurance (CPA) devices have been developed. Such CPA devices are separate elements, which can be inserted into a connector housing of a plug connector. When the connector is not properly or fully coupled to its corresponding counting connector, the CPA device cannot be fully inserted into the connector housing. Accordingly, the CPA device protrudes from the connector, indicating that full mating has not been accomplished yet. Only upon full and proper mating of the connector with the counter-connector, it is possible to fully insert the CPA device into the connector housing. This allows to visually indicating whether the plug connector has been properly and correctly mated with the counter-connector. Often, the functionalities of CPA devices and secondary locking devices are integrated in one part.

However, particularly in small connector designs, the integration of CPA devices and/or locking devices is challenging. This is due to the restricted construction space. Therefore, CPA devices and/or locking devices have to be very small, resulting in slender locking features, such as locking arms. However, slender locking features are prone to damage.

Previous designs have addressed this issue by providing shortened and slender locking features that are more rigid. However, providing more rigid locking features will lead to increased strain when the locking features are used in conventional snap or latch locking connections. Therefore, also shortened and slender locking features are prone to damage.

Further, in modern manufacturing sites, it is often desired that a plug connector is mated with a counter-connector in a fast and secure manner. This need arises among others out of economic reasons.

BRIEF SUMMARY OF THE INVENTION

Thus, it is an object of the present invention to provide a CPA device and/or locking device that is more robust. It is hence desired that the mating procedure can be accomplished with a minimal number of steps. It is therefore a further object of the present invention to provide an electrical connector assembly which allows for a fast and secure mating of a plug connector with a counter-connector.

The object of the invention is achieved by an electrical connector assembly according to claim 1 and a method to assemble an electrical connector assembly according to claim 15.

In particular, the object is achieved by an electrical connector assembly including a plug connector that is configured to be mated with a corresponding counter-connector. The plug connector includes a connector housing having a guiding feature, and a locking device being arranged movably relative to the connector housing, wherein said locking device includes a guiding member and a flexible arm. The flexible arm is configured to be flexed during mating the plug connector with the corresponding counter-connector such that the locking device can be moved into a locked position. The guiding feature and the guiding member are configured to guide the locking device from a first position to a locked position so that the flexible arm is reflexed when the locking device is in the locked position.

The locking device is configured to ensure that the connector is mated with a corresponding counter-connector correctly and cannot become loose unintentionally. Preferably, the locking device is pre-assembled with the connector housing before the plug connector is mated with a corresponding counter-connector. Thus, the locking device is partially inserted into or generally engaged with the connector housing. Alternatively, the plug connector can be mated with a corresponding counter-connector and the locking device is inserted into the connectors housing after the mating process.

The locking device is guided by the guiding feature and the guiding member from a first position to a locked position. In the locked position, the locking device improves the mating between the connector and the corresponding counter-connector. Further, by guiding the locking device so that the flexible arm is reflexed when the locking device is in the locked position, strain that is applied on the flexible arm during flexing is released again. Consequently, there is no or at least reduced strain on the flexible arm in the locked position, compared to a conventional locking device and/or a conventional CPA device. Therefore, the locking device is less prone to damage and can achieve a longer lifespan.

Preferably, the plug connector is configured to be mated with a corresponding counter-connector along a mating direction. Further, the guiding feature is preferably a stepped guiding feature so that the locking device is guided by the guiding feature along the mating direction and in a second direction that is different from the mating direction, in order to reflex the flexible arm when the locking device is in the locked position.

In particular, the stepped guiding feature guides the locking device when the locking device is moved from a first position to the locked position along the mating direction and in a second direction that is different from the mating direction. The guiding in the second direction is achieved by a step provided in the stepped guiding feature. Particularly, the stepped guiding feature is provided with at least two surface portions that are offset to each other in the second direction. Said surface portions are connected via a connecting surface so that a guiding member can be guided along, e.g. by sliding along, the surface portions.

For example, when the flexible arm is flexed in the second direction by a certain deflection, the locking device is guided in second direction by an amount that compensates said deflection. Thus, the flexible arm is reflexed when the locking device is in the locked position. The deflection is preferably in the range of 0.1 mm to 2.5 mm, more preferably in the range of 0.5 mm to 2.2 mm and most preferably in the range of range of 0.6 mm to 1.0 mm.

Further, preferred, the guiding feature is an angled guiding feature, wherein a first surface portion extends along the mating direction, to provide a guiding along the mating direction. A second angled surface portion is angled to the first surface portion and extends along the second direction, to provide a guiding along the second direction. Thus, the locking device can be guided in second direction by an amount that compensates the deflection of the flexible arm.

Preferably, the guiding feature at least partially receives the guiding member when the locking device is in the first position. With receiving the guiding member in the guiding feature, the locking device can be pre-assembled in the first position. This will facilitate the mating process of the connector with a corresponding counting connector and a subsequent movement of the locking device in the locked position. Since the locking device is at least partly engaged with the connector housing, i.e. by features of received guiding members, the starting point of the movement of the locking device into the locked position is defined.

Preferably, the guiding feature includes a guiding recess and/or a guiding gap and the locking device includes a guiding arm, which arm preferably extends parallel to the flexible arm, wherein the guiding arm is configured to be inserted into the recess and/or the gap. A guiding arm that extends parallel to the flexible arm will protect the flexible arm, as long as the locking device is not fully inserted into the connector housing.

Further, a guiding arm that is inserted into a guiding recess and/or a guiding gap of the connector housing will guide the locking device from a first position to a locked position, thereby supporting and facilitating the movement. Primarily the guiding arm is a stepped guiding arm facilitating the guiding in conjunction with a stepped guiding feature. Particularly, the guiding recess and/or guiding gap of the guiding feature is designed so that only one particular guiding arm, which is characteristic for the locking device, can be inserted. Therefore, an unintentionally assembly of an incorrect locking feature can be prevented.

Preferably the guiding feature includes a locking recess and/or a locking gap, wherein the locking recess and/or the locking gap includes a locking portion. Further, the locking device includes a locking protrusion, preferably arranged on the guiding arm, wherein the locking protrusion is configured to be inserted into the locking recess and/or the locking gap and to be locked with the locking portion when the locking device is in the locked position.

The locking between the locking protrusion and the locking portion when the locking device is in the locked position, prevents an unintentional removal of the locking device from the locked position. For example, the locking between the locking portion and the locking protrusion can be a latched locking, a bayonet locking and/or the like.

The locking recess and/or locking gap as well as the guiding recess and/or guiding gap of the guiding feature are preferably provided in a wall of the housing. They can be formed as a through opening or a groove having a certain depth. The depth of the groove is preferably in the range of 0.1 to 2.5 mm, even more preferably in the range of 0.5 to 2 mm and most preferably in the range of 0.7 to 1.5 mm.

Preferably the connector housing includes a retention portion, preferably provided within the locking recess and/or the locking gap, wherein the retention portion is configured to engage the locking device, and preferably configured to engage the locking protrusion so as to constrain a movement of the locking device in a direction opposite to the mating direction when the locking device is in the first position.

A retention portion facilitates the pre-assembly of the locking device with the connector housing, since the locking device is retained in the connector housing in the first position. Thus, the locking device cannot be unintentionally removed from the connector housing. Thus, it can be guaranteed that the locking device is positioned correctly before and/or during the mating process of the plug connector. Further, with providing a retention portion within the locking recess, the locking protrusion of the locking device can be used to secure the locking device in the connector housing, therefore the design of the locking device is facilitated; i.e. no additional retention protrusion or the like has to be provided.

Preferably the guiding feature includes a guiding surface being provided on an outer surface of the connector housing, wherein the locking device includes a guiding protrusion, preferably arranged on the guiding arm, wherein the guiding protrusion is configured to engage with the guiding surface in the first position and the locked position.

With providing a guiding surface on an outer surface of the connector housing, no recesses or gaps have to be provided in a wall of the connector housing in order to provide a guiding functionality. Thus, the connector housing is not weakened by a guiding recess or a gap. This is in particular advantageous when very small connector housings shall be provided. It has to be noted that the guiding recesses or guiding gaps as well as the locking recesses or locking gaps as well as the guiding surfaces can be provided as single guiding feature. Alternatively, multiple guiding features and/or multiple different guiding features can be provided, as described above. Particularly, providing multiple different guiding features improves the guiding of the locking device in the connector housing so that the movement of the locking device from the first position to the locked position is facilitated. For example, the locking device is less prone for being jammed or blocked when being moved from the first position to the locked position.

Preferably the first position is a pre-locked position, and the flexible arm and the connector housing are configured to be in blocking contact, if the locking device is arranged in the pre-locked position so as to inhibit movement of the locking device from the pre-locked position into the locked position, wherein the flexible arm is preferably not flexed in the pre-locked position.

Inhibiting the movement of the locking device from a pre-locked position to a locked position guarantees that the locking device is not moved to the locked position before the connector is correctly mated with the counter-connector. Thus, the locking device can serve as connector position assurance (CPA) device. In this case, the locking device can be moved to the locked position, if the flexible arm is flexed so that the blocking contact is released and the movement of the locking device from the pre-locked position into the locked position is no longer inhibited.

Preferably, the locking device includes a blocking protrusion and the connector housing includes a corresponding blocking projection, wherein said blocking protrusion and said blocking projection are configured to provide the blocking contact between the flexible arm and the connector housing. Preferably, the flexible arm transfers forces acting in mating direction onto the locking device along said flexible arm in longitudinal direction thereof and via the blocking projection and the blocking protrusion, provided in the connector housing, onto the connector housing so as to inhibit movement of the secondary locking device from the pre-locked position into the locked position. Providing a blocking projection and a corresponding blocking protrusion allows to define force application points so that the flexible arm and/or the connector housing can be designed strain optimized with regard to said force application points. Thus, the overall live span of the connector housing and/or the locking device can be increased.

Preferably, the flexible arm of the locking device includes a releasing protrusion that is configured to engage with the counter-connector to thereby flex the flexible arm during mating the plug connector with the corresponding counter-connector such that the locking device can be moved into the locked position. Providing a releasing protrusion that can engage with the counter-connector to thereby flex the flexible arm, will release the flexible arm from the blocking contact with the connector housing in order to allow the movement of the locking device into a blocked position. Thus, the locking device can be used as a CPA device, indicating a correct coupling of the connector with the corresponding counter-connector. The releasing protrusion can be an inclined surface that can slide along a portion of the counter-connector, in order to flex the flexible arm.

Preferably, the connector housing includes a flexible lever, having a primary locking feature configured to provide a primary locking function when the plug connector is mated with a corresponding counter-connector, wherein the primary locking function preferably can be unlocked when said flexible lever is flexed. Providing a flexible lever having a primary locking feature allows to lock the connector housing to a corresponding counter-connector, independent of the presence of the locking device. Thus, for example, the plug connector can be mated and locked with the corresponding counter-connector and the locking device can be inserted afterwards. By providing an unlock-functionality, the plug connector can be removed from the corresponding counter-connector, without any damages. If no unlock-functionality is provided, the plug connector can be permanently locked to the counter-connector, which is desirable in certain applications.

Preferably, the locking device includes a primary jamming portion provided on the flexible arm, wherein the primary jamming portion is configured to block an unlock movement of the primary locking feature when the locking device is in the locked position. Providing a jamming portion that blocks an unlock movement of the primary locking feature will secure and maintain the primary locking between the plug connector and the corresponding counter-connector. Consequently, as long as the locking device is in its locked position, the risk of unintentionally loosening of the locking between the plug connector and the corresponding counter-connector can be reduced.

Preferably, the locking device includes a secondary jamming portion, wherein the secondary jamming portion is preferably an element separate from the flexible arm. When the locking device is in the first and/or pre-locked position, the secondary jamming portion does not engage the flexible lever of the connector housing. When the locking device is moved from the first and/or pre-locked position to the locked position, said secondary jamming portion engages the flexible lever of the connector housing at least partially to prevent a flexing of said flexible lever.

With providing a secondary jamming portion, the blocking of an unlock movement of the primary locking feature can be improved. Since the unlock movement of the primary locking feature requires a flexing of the flexible lever, a blocking of the flexing of the flexible lever also prevents an unlock movement of the primary locking feature. Thus, the primary locking of the plug connector with the counter-connector can be additionally secured. Preferably, the primary jamming portion and the secondary jamming portion are provided as redundant portions. This can be achieved by providing the secondary jamming portion as an element separate from the flexible arm. Thus, the blocking of the unlock movement can be effectively guaranteed.

Preferably, the mating of the plug connector to the corresponding counter-connector is achieved by applying a pressing force on the locking device in the mating direction, wherein the locking device is configured to be moved from the first to the locked position by further applying said pressing force. Allowing to mate the plug connector with a corresponding counter-connector by applying a pressing force on the locking device and subsequently or simultaneously moving the locking device from a first position to the locked position by further applying of the pressing force, allows to mate the plug connector with the corresponding counter-connector and move the locking device in the locked position in one assembly step. Thus, assembly time can be reduced. This is in particular relevant for industrial applications, such as industrial or automobile assembly lines.

The object of the invention is further achieved by a method to assemble the electrical connector assembly as previously described, wherein the method includes the steps of:

- providing a connector housing, including a guiding feature;
- providing a locking device, including a guiding member and a flexible arm;
- arranging the locking device in a first position to form a plug connector, wherein the guiding feature receives the guiding member at least partially;
- mating the plug connector with a corresponding counter-connector, and thereby flexing the flexible arm of the locking device such that the locking device can be moved into the locked position;
- moving the locking device into the locked position, wherein the guiding feature guide the locking device from the first position to the locked position so that the flexible arm is reflexed when the locking device is in the locked position.

The above described method allows to provide additional locking functionality to secure the plug connector and the corresponding counter-connector and to use the locking device as a CPA device, indicating the correct coupling of the plug connector with the corresponding counter-connector.

Preferably, the mating of the plug connector to the corresponding counter-connector is achieved by applying a pressing force on the locking device in the mating direction, and wherein the locking device is moved from the first position to the locked position by further applying said pressing force. As previously described, applying a pressing force for mating the plug connector and for moving the locking device in the locked position facilitates the assembly and helps to reduce assembly time and therefore costs.

These and other objects, which become apparent by reading the following description, are achieved by the present invention according to the subject matter of the independent claims.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
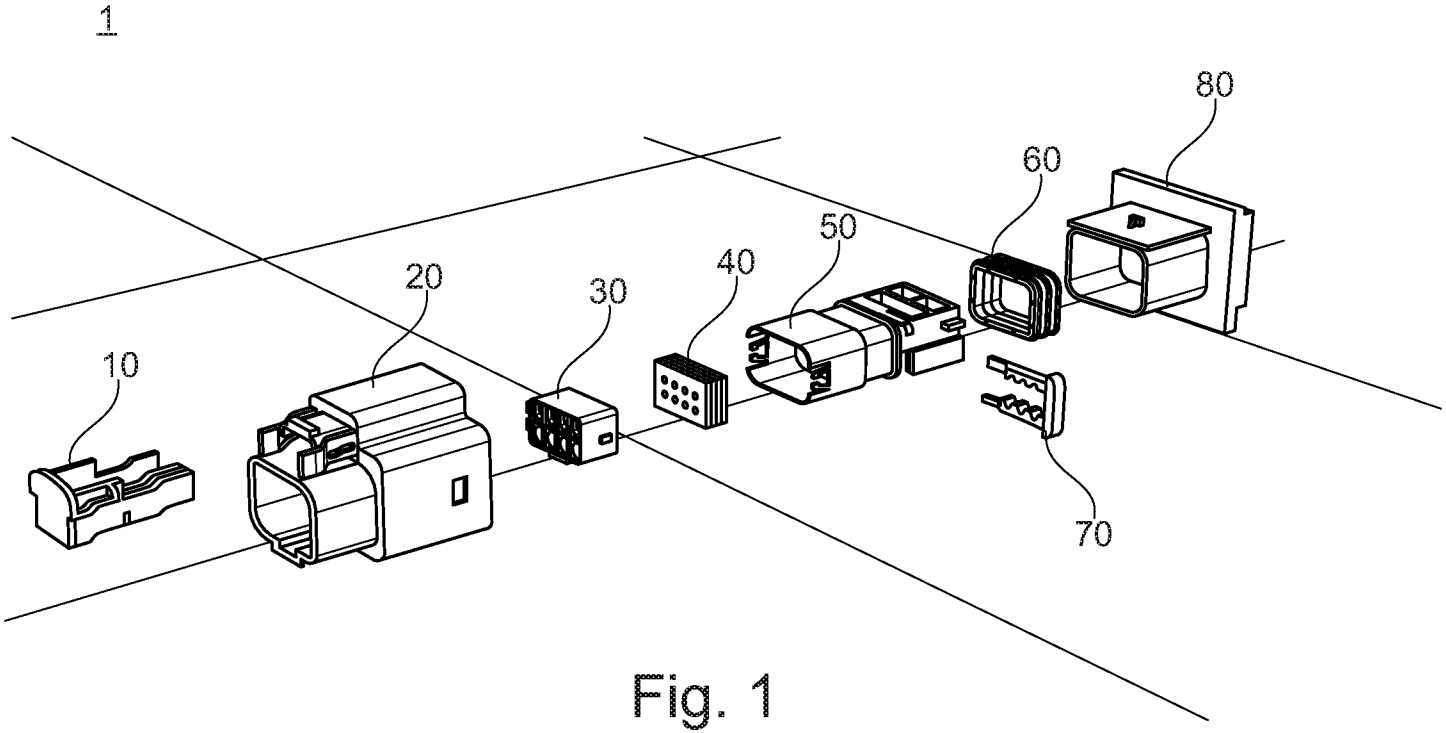
FIG. 1 is an exploded view of an electrical connector assembly.

FIG. 1 shows a non-limiting example of a plug connector, wherein the plug connector includes a locking device 10, a connector housing 20, a terminal collector 30, a first sealing device 40, an inner housing 50, a second sealing device 60 and a terminal position assurance device (TPA) 70. The components 10, 20, 30, 40, 50, 60, 70 can be assembled to form a plug connector. That plug connector can be mated with the corresponding counter-connector 80. The inner housing 50 is configured to receive single electrical terminals or electrical pins (not shown) of the plug connector. The TPA device 70 can only be inserted into the inner housing 50, if all terminals and/or pins are correctly collected and installed within the terminal collector 30. Preferably, the terminal collector 30 provides protection to the first sealing device 40 when the first sealing device 40 is received in the terminal collector 30.

Figure 2:
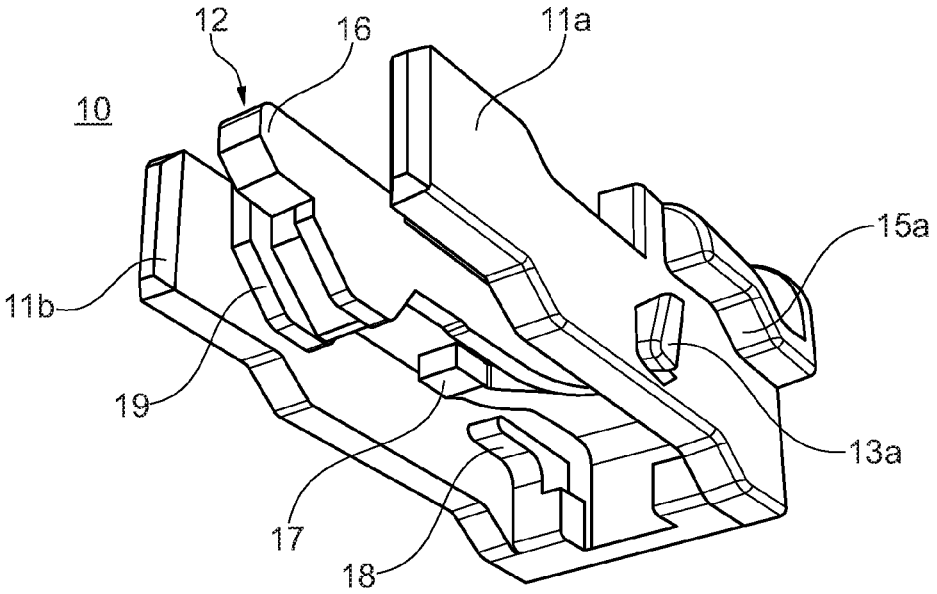
FIG. 2 is a schematic view of a locking device.

FIG. 2 shows an exemplary embodiment of the locking device 10. The locking device 10 includes a flexible arm 12 that extends in the mating direction and is arranged between two guiding arms 11*a*, 11*b*. The guiding arms are stepped guiding arms that are used as guiding members of the locking device 10. Further, on the side surfaces of each guiding arm 11*a*, 11*b* and locking protrusions 13*a*, 13*b* are arranged. These locking protrusions 13*a*, 13*b* are used as guiding members and provide a locking functionality when engaging with a corresponding locking recess or a corresponding locking gap as described herein later. Further, a stepped guiding protrusion 15*a*, 15*b* is provided on a side surface of the corresponding guiding arms 11*a*, 11*b*. These stepped guiding protrusion 15*a*, 15*b* are used as guiding members and therefore configured to guide the locking device 10 from a first position to a locked position.

Further, the flexible arm 12 includes a blocking protrusion 17 for providing a blocking contact between the flexible arm 12 and the connector housing 20. The flexible arm 12 further includes a releasing protrusion 19 for releasing the blocking contact between the blocking protrusion 17 and the connector housing 20. The releasing protrusion 19 includes an inclined surface. The primary jamming portions 16 are provided at a distal end of the flexible arm 12 and are configured to block an unlock movement of the primary locking feature of the connector housing 20.

Figure 3:
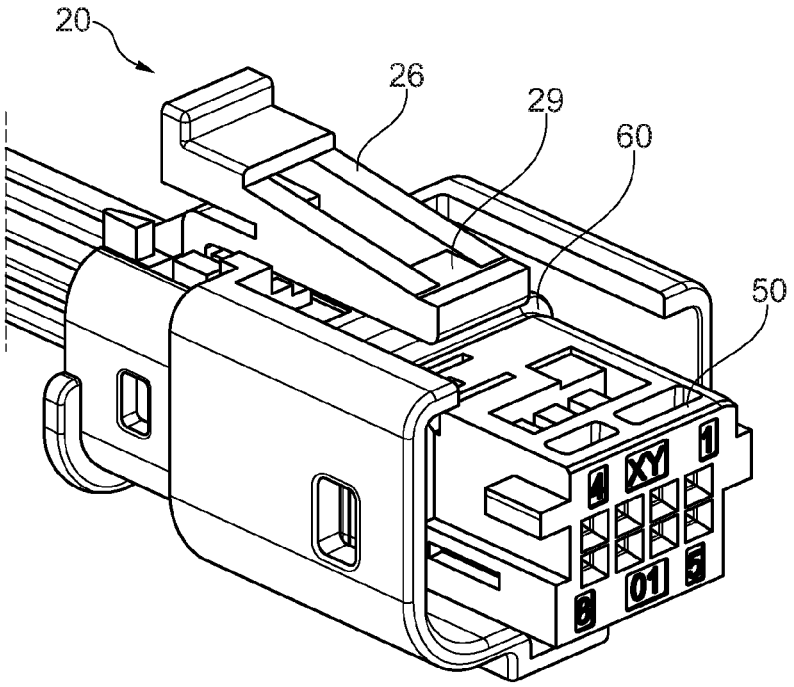
FIG. 3 is a schematic sectional view of the plug connector, wherein the locking device is removed.

FIG. 3 shows a partial cut view of the plug connector, wherein the top cover of the connector housing 20 is not shown. Further, the locking device is not shown in FIG. 3. The connector housing 20 includes a flexible lever 26 having a primary locking feature 29. The primary locking feature 29 can engage with a primary locking projection provided on a corresponding counter-connector. The flexible lever 26 can be flexed in order to engage with the primary locking projection of the corresponding counter-connector, as will be described in greater detail later on. Further, the inner housing 50 and the second sealing device 60 are shown in FIG. 3.

Figure 4:
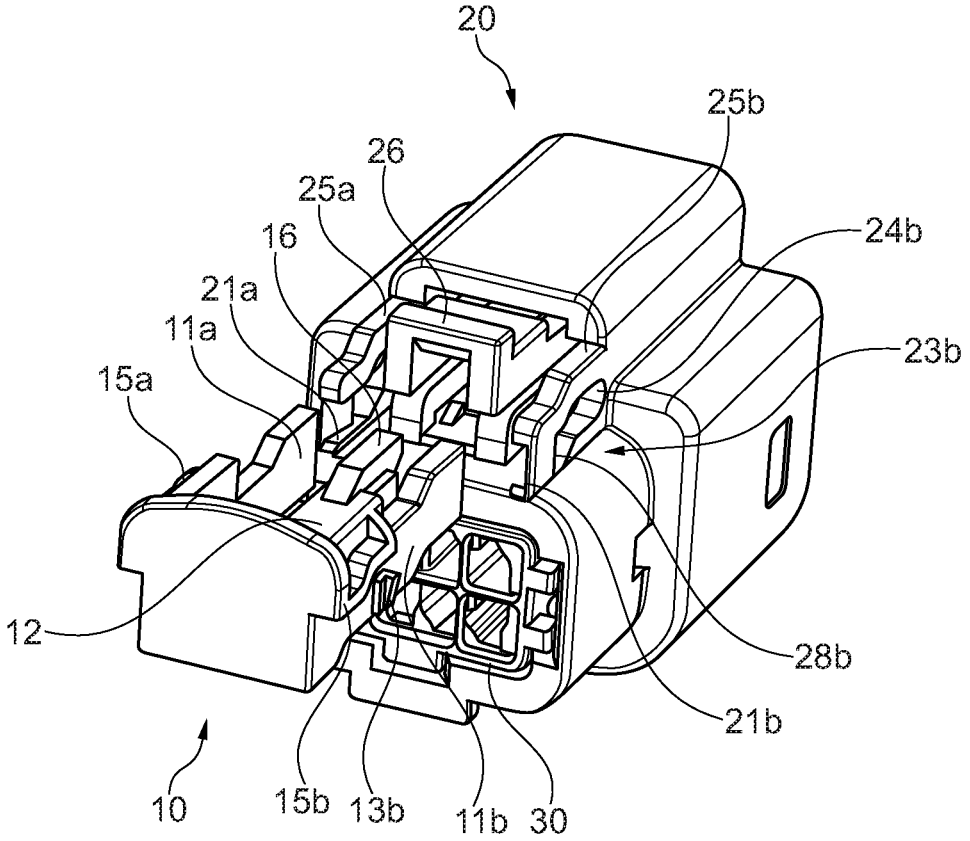
FIG. 4 is a schematic cut view of the plug connector with the locking device being in a first position before assembly.

FIG. 4 shows a schematic view of the plug connector, wherein the locking device 10 is removed from the connector housing 20. The connector housing 20 includes a flexible lever 26. Further, the connector housing 20 includes a variety of different guiding feature. Firstly, two guiding recesses 21*a*, 21*b* are provided. These guiding recesses are configured to receive the guiding arms 11*a*, 11*b* of the locking device 10. Secondly, two locking gaps 23*a*, 23*b* are provided. The locking gaps 23*b* are provided in a wall of the connector housing and are formed as through openings. Said locking gaps 23*b* are provided with a retention portion 28*b* and a locking portion 24*b*. The locking gap 23*b* receives the locking protrusion 13*b* and guides the same from a pre-locked position into the locked position of the locking device. In the pre-locked position, the locking protrusion 13*b* engages with the retention portion 28*b* to secure the locking device 10 from being removed from the connector housing 20. In the locked position of the locking device, the locking protrusion 13*b* engages with the locking portion 24*b* so as to provide an additional locking. Thirdly, the connector housing is provided with guiding surfaces 25*a*, 25*b* being provided on an outer surface of the connector housing 20. The guiding surfaces 25*a*, 25*b* can engage with guiding protrusions 15*a*, 15*b* to guide the locking device from the first position to the locked position.

Figure 5A:
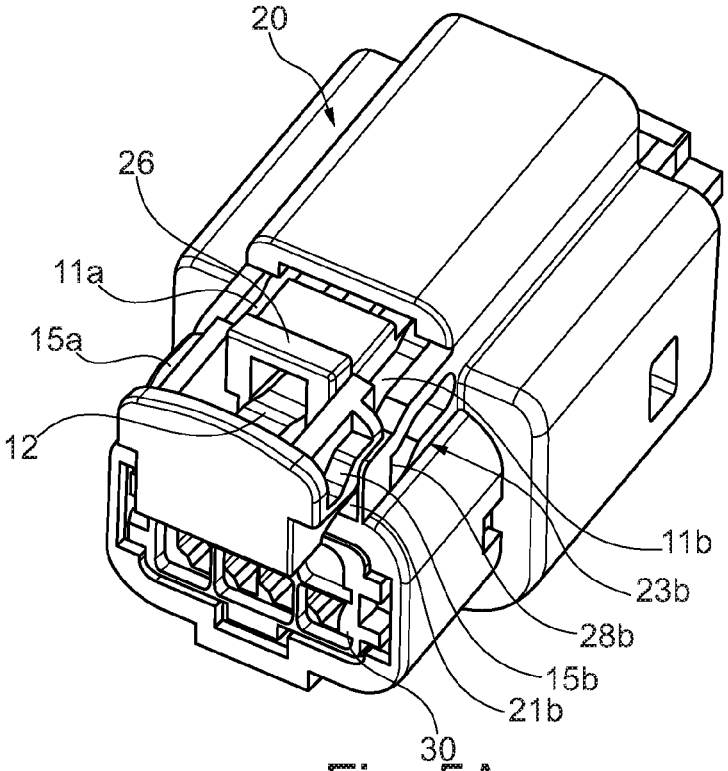
FIG. 5A is a schematic view of the locking device being in a pre-locked position.
Figure 5B:
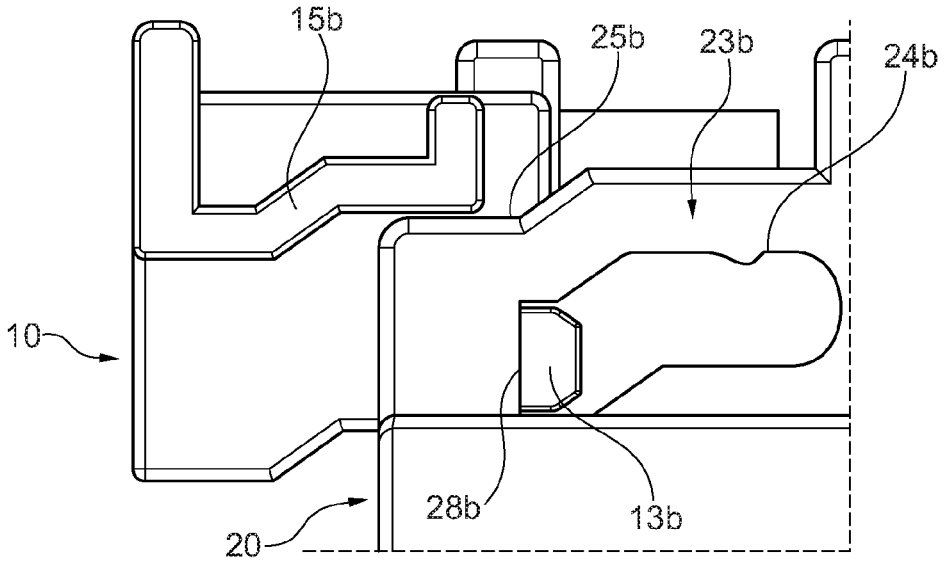
FIG. 5B is a schematic view of the locking device being in a pre-locked position.

In FIGS. 5A to 5D, the pre-locked position of the locking device is illustrated. Same reference numbers relate to same elements. As shown in FIG. 5A, the locking device 10 is at least partially inserted into the connector housing 20 in the pre-locked position. Thus, the guiding arms 11*a*, 11*b* are at least partially received in the guiding recesses 21*a*, 21*b*. Further, the guiding protrusions 15*a* and 15*b* engage with the corresponding guiding surfaces 25*a*, 25*b*. As can be best seen in FIG. 5B, the locking protrusion 13*b* engages with the retention portion 28*b* to prevent the locking device 10 from being unintentionally removed from the connector housing 20. Further, the locking gap 23*b* includes a locking portion 24*b* that is formed as a latching protrusion for providing a latch locking between the locking device 10 and the connector housing 20 in the locked position.

Figure 5C:
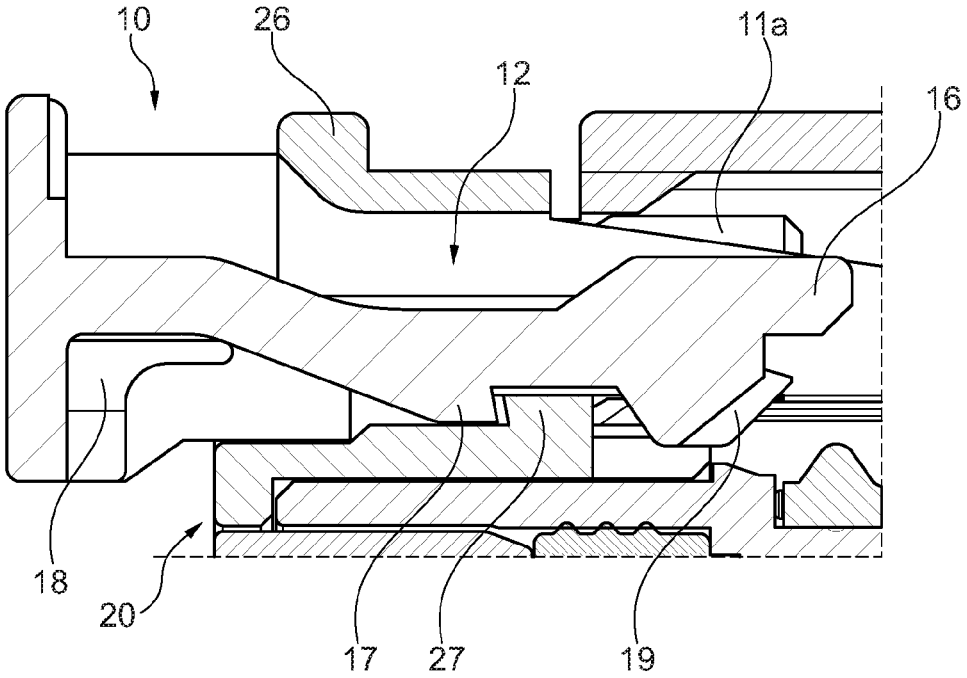
FIG. 5C is a schematic cut view of the plug connector with the locking device being in a pre-locked position.
Figure 5D:
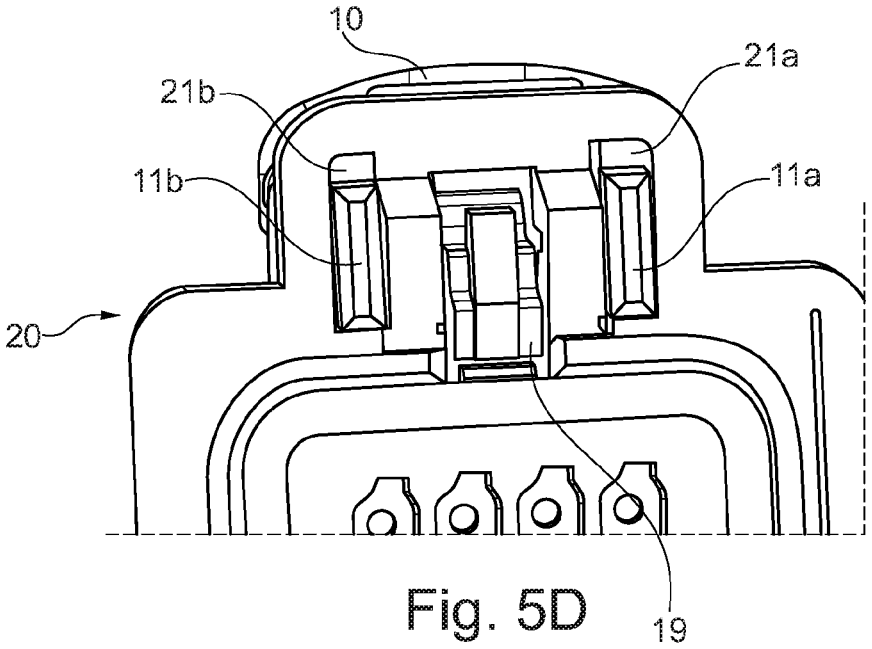
FIG. 5D is a further cut view of the plug connector of FIG. 5C.

FIG. 5C is a cut view of the plug connector, wherein the flexible arm 12 of the locking device 10 is cut along its longitudinal axis. The blocking protrusion 17 of the flexible arm 12 is in blocking contact with the blocking projection 27 of the connector housing 20, thus preventing a movement of the locking device 10 from the pre-locked position into the locked position. Further, the flexible arm 12 is provided at its distal end with a primary jamming portion 16 and a releasing protrusion 19. Further, the locking device 10 includes a secondary jamming portion 18. The secondary jamming portion 18 prevents the flexible lever 26 of the connector housing 20 to be flexed, if the locking device 10 is in the locked position. In the pre-locked position as shown in FIG. 5C, the flexible lever 26 can be flexed so that a primary locking between the primary locking feature and a primary locking projection of a corresponding counter-connector can be unlocked. FIG. 5D shows the plug connector in a further cut view. The guiding arms 11*a*, 11*b* are at least partially received in the guiding recesses 21*a*, 21*b*.

Figure 6A:
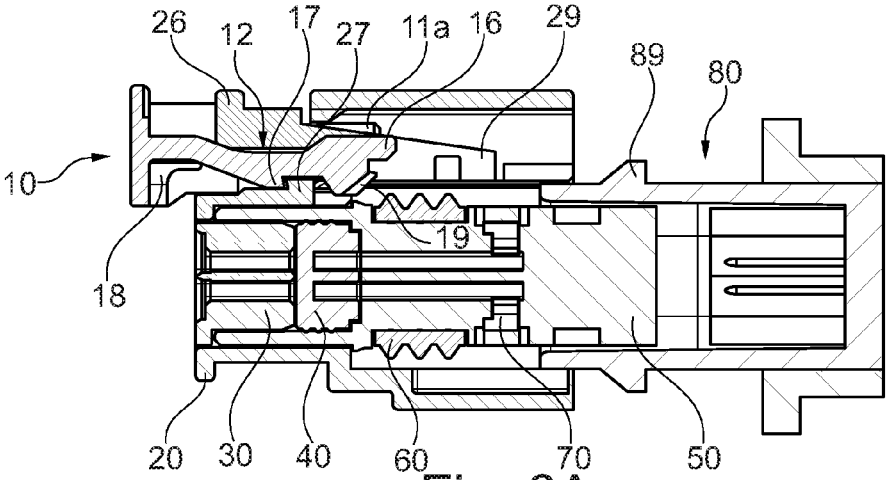
FIG. 6A is a schematic cut view of the plug connector and the counter-connector.
Figure 6B:
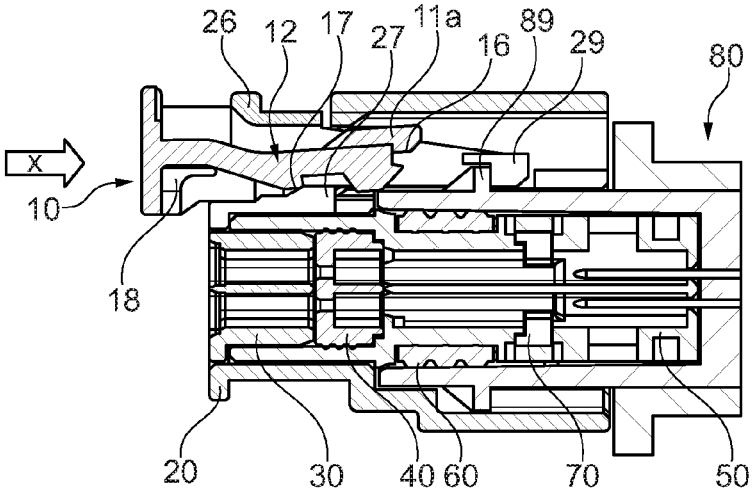
FIG. 6B is a schematic cut view of the plug connector and the counter-connector.
Figure 6C:
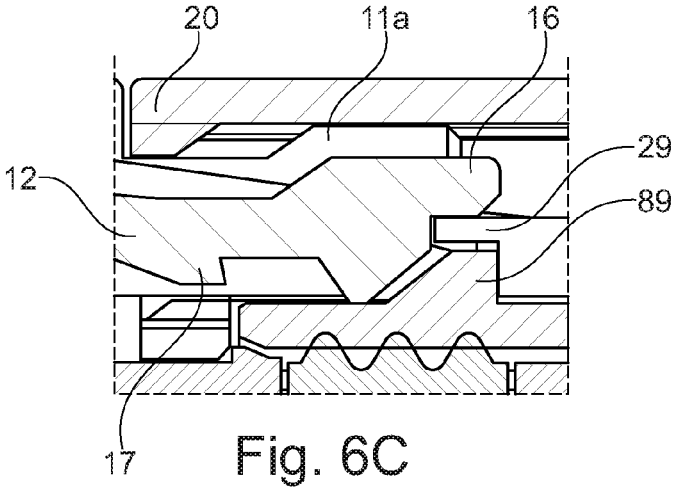
FIG. 6C is a schematic detailed cut view of the primary jamming portion.

FIGS. 6A to 6C show the movement of the locking device 10 from a first position or a pre-locked position (FIG. 6A) to a locked position (FIG. 6C). In FIG. 6A, the plug connector is in the pre-locked position, as described in greater detail with respect to FIGS. 5A to 5D. The blocking protrusion 17 and the blocking projection 27 are in blocking contact, preventing the locking device 10 from being moved to the locked position. Further, the plug connector, includes the locking device 10, the connector housing 20, the terminal collector 30, first and second sealing devices 40, 60, the TPA device 70 and the inner housing 50. Particularly, the plug connector is about to be mated with a corresponding counter-connector 80. The corresponding counter-connector includes a primary locking projection 89.

When the plug connector is correctly mated with the corresponding counter-connector 80, as shown in FIG. 6B, the releasing protrusion 19 of the flexible arm 12 of the locking device 10 engages with the counter-connector 80 so that the flexible arm 12 is flexed in a direction substantially perpendicular to the mating direction x, i.e. in the second direction z. By applying a force onto the locking device 10 in the mating direction x, the flexible arm 12 can be flexed and the locking contact between the blocking protrusion 17 and the blocking projection 27 is released so that the locking device 10 can be moved to the locked position. As can be seen in FIG. 6B, the primary locking feature 29 of the flexible lever 26 engages with the primary locking projection 89 of the corresponding counter-connector 80.

As shown in FIG. 6C, when the locking device 10 is in the locked position, the primary jamming portion 16 of the flexible arm 12 blocks an unlock movement of the primary locking feature 29. Thus, the locking between the plug connector and the corresponding counter-connector is secured.

Figure 7A:
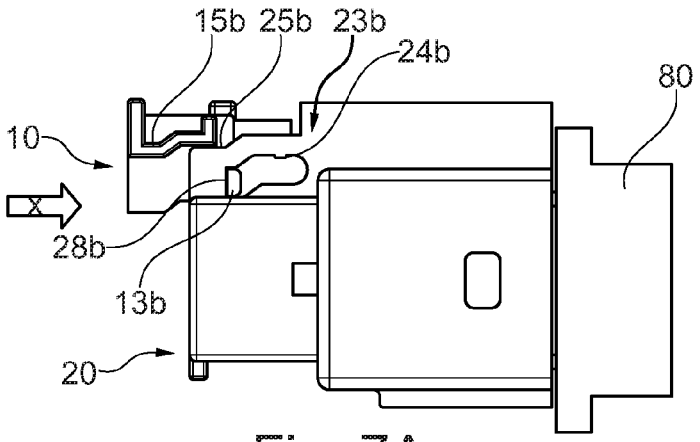
FIG. 7A is a schematic side view of the plug connector and the corresponding counter-connector.
Figure 7B:
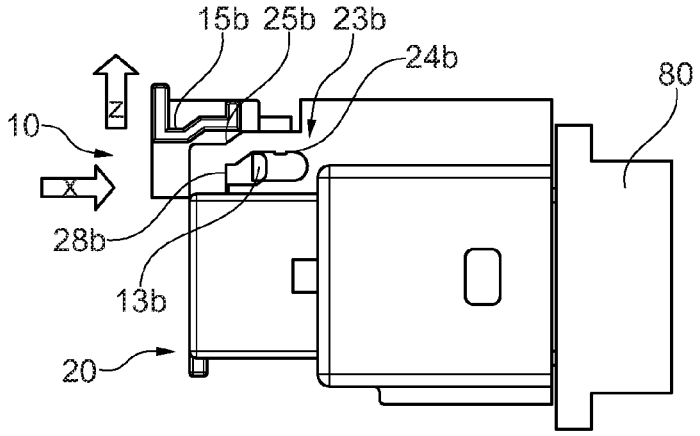
FIG. 7B is a schematic side view of the plug connector and the corresponding counter-connector.
Figure 7C:
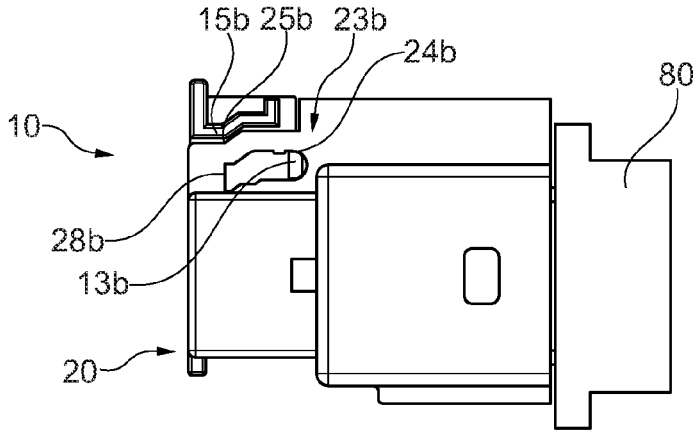
FIG. 7C is a schematic side view of the plug connector and the corresponding counter-connector.

FIGS. 7A to 7C show the movement of the locking device 10 from a first position and/or a pre-locked position to a locked position. In FIG. 7A, the locking device 10 is shown in the pre-locked position. The locking protrusion 13*b* is received within the locking gap 23*b*, wherein the locking protrusion 13*b* engages with the retention portion 28*b*. Thus, the locking device 10 is prevented from being removed from the connector housing 20 unintentionally. If the plug connector is correctly mated with the corresponding counter-connector 80, the locking device 10 can be moved to the locked position.

As shown in FIG. 7B, by applying a force in the mating direction x, the locking device 10 is guided by the guiding feature 23*b*, 25*b*, i.e. the locking gap 23*b* and the guiding surface 25*b* along the mating direction x and in a second direction z that is different, in particular perpendicular to the mating direction x. Thus, the flexible arm 12 of the locking device 10 (not shown) is reflexed and no or at least reduced strain is applied on the flexible arm 12, if the locking device 10 is in the locked position.

FIG. 7C shows locking device 10 in the locked position. The locking protrusion 13*b* engages with the locking portion 24*b* of the locking gap 23*b*, thereby securing the locking device 10 in the locked position.

Figure 8A:
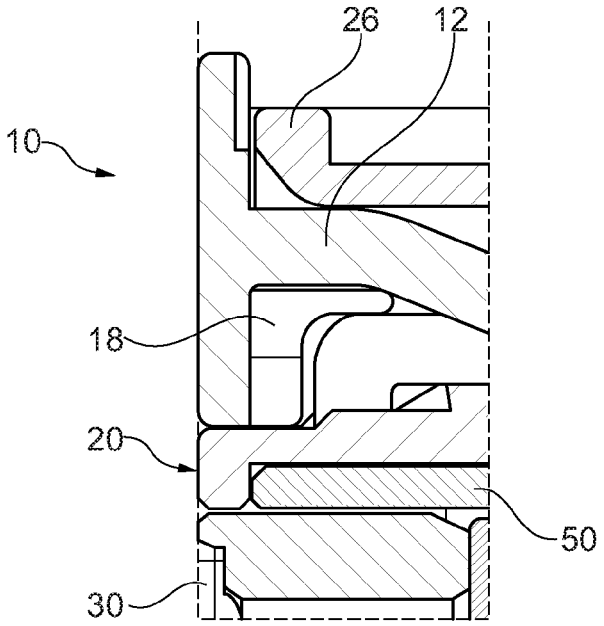
FIGS. 8A and 8B are detailed cut views of the second jamming portion.
Figure 8B:
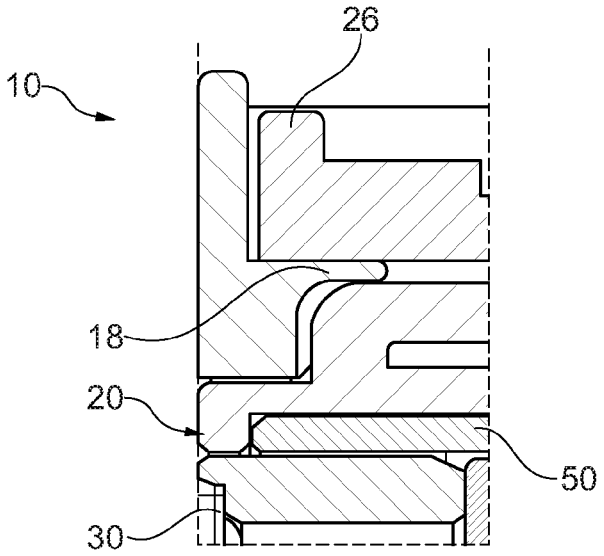

Besides the blocking of an unlock-movement of the primary locking feature 29 of the flexible lever 26, the flexing of the flexible lever 26 can be prevented as shown in FIGS. 8A and 8B. FIGS. 8A and 8B show detailed cut views of the secondary jamming portion 18 that is provided on the locking device 10. As shown in FIG. 8A, the secondary jamming portion 18 is provided beneath the flexible lever 26 opposite to the primary locking feature 29. Thereby, a flexing of the flexible lever 26, that would result in an unlock movement of the primary locking feature 29, is prevented. Further, as shown in FIG. 8B, also a lateral portion of the flexible arm 12 engages with the flexible lever 26 when the locking device 10 is in the locked position, in order to prevent a flexing of the flexible lever 26 and to inhibit an unlock-movement of the primary locking feature 29.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LISTING OF THE REFERENCE NUMBERS

1 Electrical connector assembly
10 Locking device
11*a, b* Guiding arms
12 Flexible arm
13*a, b* Locking protrusion
15*a, b* Guiding protrusion
16 Primary jamming portion
17 Blocking protrusion
18 Secondary jamming portion
19 Releasing protrusion
20 Connector housing
21*a, b* Guiding recess
23*a, b* Locking gap
25*a, b* Guiding surface
26 Flexible lever
27 Blocking projection
28*b* Retention portion
29 Primary locking feature
30 Terminal collector
40 First sealing device
50 Inner housing
60 Second sealing device
70 Terminal position assurance device

80 Corresponding counter-connector
89 Primary locking projection
x Mating direction
z Second direction

We claim:

1. An electrical connector assembly, comprising a plug connector that is configured to be mated with a corresponding counter-connector, wherein the plug connector comprises:

a connector housing having a guiding feature; and a locking device movably arranged relative to the connector housing, wherein said locking device comprises a guiding member and a flexible arm, wherein the flexible arm is configured to be flexed during mating the plug connector with the corresponding counter-connector such that the locking device can be moved into a locked position, wherein the guiding feature and the guiding member are configured to guide the locking device from a first position to the locked position so that the flexible arm is reflexed when the locking device is in the locked position, wherein the plug connector is configured to be mated with the corresponding counter-connector along a mating direction and wherein the guiding feature is a stepped guiding feature so that the locking device is guided by the guiding feature along the mating direction and in a second direction that is different from the mating direction in order to reflex the flexible arm when the locking device is in the locked position.

2. The electrical connector assembly according to claim 1, wherein the guiding feature at least partially receives the guiding member when the locking device is in the first position.

3. The electrical connector assembly according to claim 2, wherein the guiding feature comprises a guiding recess or a guiding gap, wherein the locking device comprises a guiding arm extending parallel to the flexible arm, and wherein the guiding arm is configured to be inserted into the guiding recess or the guiding gap.

4. The electrical connector assembly according to claim 3, wherein the guiding feature comprises a locking recess or a locking gap, wherein the locking recess or the locking gap comprises a locking portion, wherein the locking device comprises a locking protrusion arranged on the guiding arm, and wherein the locking protrusion is configured to be inserted into the locking recess or the locking gap and to be locked with the locking portion when the locking device is in the locked position.

5. The electrical connector assembly according to claim 4, wherein the connector housing comprises a retention portion provided within the locking recess or the locking gap, wherein the retention portion is configured to engage the locking device, and configured to engage the locking protrusion so as to constrain a movement of the locking device in a direction opposite to the mating direction when the locking device is in the first position.

6. The electrical connector assembly according to claim 3, wherein the guiding feature comprises a guiding surface being provided on an outer surface of the connector housing, wherein the locking device comprises a guiding protrusion arranged on the guiding arm, and wherein the guiding protrusion is configured to engage with the guiding surface in the first position and the locked position.

7. The electrical connector assembly according to claim 1, wherein the first position is a pre-locked position, and wherein the flexible arm and the connector housing are configured to be in blocking contact, if the locking device is arranged in the pre-locked position so as to inhibit movement of the locking device from the pre-locked position into the locked position, wherein the flexible arm is not flexed in the pre-locked position.

8. The electrical connector assembly according to claim 7, wherein the locking device comprises a blocking protrusion and wherein the connector housing comprises a corresponding blocking projection, wherein said blocking protrusion and said corresponding blocking projection are configured to provide the blocking contact between the flexible arm and the connector housing.

9. The electrical connector assembly according to claim 1, wherein the flexible arm of the locking device comprises a releasing protrusion that is configured to engage with the corresponding counter-connector to thereby flex the flexible arm during mating the plug connector with the corresponding counter-connector such that the locking device can be moved into the locked position.

10. The electrical connector assembly according to claim 1, wherein the connector housing comprises a flexible lever having primary locking feature configured to provide a primary locking function when the plug connector is mated with the corresponding counter-connector, wherein the primary locking function can be unlocked when said flexible lever is flexed.

11. The electrical connector assembly according to claim 1, wherein the mating of the plug connector to the corresponding counter-connector is achieved by applying a pressing force on the locking device in the mating direction, and wherein the locking device is configured to be moved from the first to the locked position by further applying said pressing force.

12. An electrical connector assembly, comprising a plug connector that is configured to be mated with a corresponding counter-connector, wherein the plug connector comprises:

a connector housing having a guiding feature; and a locking device movably arranged relative to the connector housing, wherein said locking device comprises a guiding member and a flexible arm, wherein the flexible arm is configured to be flexed during mating the plug connector with the corresponding counter-connector such that the locking device can be moved into a locked position, wherein the guiding feature and the guiding member are configured to guide the locking device from a first position to the locked position so that the flexible arm is reflexed when the locking device is in the locked position, wherein the connector housing comprises a flexible lever having primary locking feature configured to provide a primary locking function when the plug connector is mated with the corresponding counter-connector, wherein the primary locking function can be unlocked when said flexible lever is flexed, wherein the locking device comprises a primary jamming portion provided on the flexible arm, and wherein the primary jamming portion is configured to block an unlock movement of the primary locking feature when the locking device is in the locked position.

13. The electrical connector assembly according to claim 12, wherein the locking device comprises a secondary jamming portion, wherein the secondary jamming portion is an element separate from the flexible arm, and wherein when the locking device is in the first position or the pre-locked position the secondary jamming portion does not engage the flexible lever of the connector housing and when the locking device is moved from the first position or the pre-locked position to the locked position said secondary jamming portion at least partially engages the flexible lever of the connector housing so as to prevent a flexing of said flexible lever.

* * * * *